US011787592B2

(12) United States Patent
Pang et al.

(10) Patent No.: US 11,787,592 B2
(45) **Date of Patent: *Oct. 17, 2023**

(54) HEAT-SEALABLE PAPERBOARD STRUCTURES AND ASSOCIATED PAPERBOARD-BASED CONTAINERS

(71) Applicant: WestRock MWV, LLC, Atlanta, GA (US)

(72) Inventors: Jiebin Pang, Glen Allen, VA (US); Natasha G. Melton, Richmond, VA (US); Steven Parker, Raleigh, NC (US); Teresa Krug, Henrico, VA (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/831,896

(22) Filed: Jun. 3, 2022

(65) Prior Publication Data

US 2022/0297873 A1 Sep. 22, 2022

Related U.S. Application Data

(63) Continuation of application No. 16/390,491, filed on Apr. 22, 2019, now Pat. No. 11,377,251.

(Continued)

(51) Int. Cl.
*B65D 3/28* (2006.01)
*D21H 19/40* (2006.01)

(Continued)

(52) U.S. Cl.
CPC ..... *B65D 3/28* (2013.01); *B65D 3/12* (2013.01); *B65D 25/14* (2013.01); *D21H 19/40* (2013.01);

(Continued)

(58) Field of Classification Search
CPC ..... B65D 3/06; B65D 3/28; B65D 3/12

(Continued)

(56) References Cited

U.S. PATENT DOCUMENTS 5,731,377 A 3/1998 Friel
5,763,100 A * 6/1998 Quick ..... D21H 19/40 428/903.3

(Continued)

FOREIGN PATENT DOCUMENTS

EP 0991815 B1 4/2000
EP 2719825 A1 4/2014

(Continued)

OTHER PUBLICATIONS

AkzoNobel, media release, "AkzoNobel creates world's first fully compostable and recyclable paper cup,"https://www.akzonobel.com/en/for-media/media-releases-and-features/akzonobel-creates-worlds-first-fully-compostable-and (Aug. 7, 2014).

(Continued)

*Primary Examiner* — Nathan J Newhouse
*Assistant Examiner* — Phillip D Schmidt
(74) *Attorney, Agent, or Firm* — Walters & Wasylyna LLC

(57) ABSTRACT

A paperboard structure including a paperboard substrate having a first major side and a second major side, a barrier coating layer on the first major side of the paperboard substrate, a top coat on the first major side of the paperboard substrate, wherein the barrier coating layer is positioned between the paperboard substrate and the top coat, and a heat-sealable barrier coating layer on the second major side of the paperboard substrate.

20 Claims, 5 Drawing Sheets

Related U.S. Application Data

(60) Provisional application No. 62/663,639, filed on Apr. 27, 2018.

(51) Int. Cl.

| | |
|---|---|
| ***B65D 3/12*** | (2006.01) |
| ***B65D 25/14*** | (2006.01) |
| ***D21H 19/84*** | (2006.01) |
| *B65D 3/06* | (2006.01) |
| *D21H 19/44* | (2006.01) |

(52) U.S. Cl.
CPC ..... *D21H 19/84* (2013.01); *B65D 3/06* (2013.01); *D21H 19/44* (2013.01)

(58) Field of Classification Search
USPC ..... 229/400
See application file for complete search history.

(56) References Cited

U.S. PATENT DOCUMENTS

| | | | | |
|---|---|---|---|---|
| 6,135,936 | A | 10/2000 | Brown et al. | |
| 8,758,567 | B2 * | 6/2014 | Brungardt | C08G 73/0206 162/164.1 |
| 9,068,105 | B2 | 6/2015 | VonFelden et al. | |
| 9,732,474 | B2 | 8/2017 | Koenig et al. | |
| 9,803,088 | B2 | 10/2017 | Iyer et al. | |
| 9,868,876 | B2 | 1/2018 | Pratt et al. | |
| 10,590,606 | B2 * | 3/2020 | Mongrain | D21H 19/56 |
| 11,174,063 | B2 * | 11/2021 | Linvill | B65D 3/06 |
| 11,377,251 | B2 * | 7/2022 | Pang | B65D 3/12 |
| 2002/0136913 | A1 | 9/2002 | Schaedler et al. | |
| 2003/0226648 | A1 * | 12/2003 | McDonnell | B32B 29/06 162/158 |
| 2006/0147659 | A1 * | 7/2006 | Foley | B41M 5/52 428/32.24 |
| 2007/0087212 | A1 * | 4/2007 | Iyengar | B32B 7/06 428/513 |
| 2011/0046284 | A1 | 2/2011 | Berube et al. | |
| 2011/0168771 | A1 | 7/2011 | Yan | |
| 2011/0217518 | A1 * | 9/2011 | Repecki | B32B 23/08 428/165 |
| 2011/0262745 | A1 | 10/2011 | Ronka | |
| 2012/0302660 | A1 | 11/2012 | Stanssens et al. | |
| 2015/0111011 | A1 | 4/2015 | Hoekstra et al. | |
| 2015/0344729 | A1 | 12/2015 | Breese et al. | |
| 2016/0153149 | A1 | 6/2016 | Mongrain | |
| 2016/0168799 | A1 * | 6/2016 | Constant | D21H 21/16 493/110 |
| 2016/0348318 | A1 * | 12/2016 | Koenig | D21H 19/54 |
| 2017/0002517 | A1 | 1/2017 | Pang et al. | |
| 2018/0058010 | A1 * | 3/2018 | Mongrain | D21H 19/56 |
| 2018/0135251 | A1 | 5/2018 | Constant et al. | |
| 2018/0142418 | A1 * | 5/2018 | Sundholm | D21H 25/06 |
| 2018/0245291 | A1 | 5/2018 | Pang et al. | |
| 2019/0177920 | A1 * | 6/2019 | Koenig | D21H 17/37 |

FOREIGN PATENT DOCUMENTS

| | | | |
|---|---|---|---|
| JP | 2013082109 | A1 | 5/2013 |
| WO | 1994026513 | A1 | 11/1994 |
| WO | 1998054409 | A1 | 12/1998 |
| WO | 2010135613 | A1 | 11/2010 |
| WO | 2014005697 | A2 | 1/2014 |
| WO | 2018094130 | A1 | 5/2014 |
| WO | 2016170229 | A1 | 10/2016 |
| WO | 2016183314 | A1 | 11/2016 |
| WO | 2018200790 | A1 | 11/2018 |
| WO | 2019209720 | A1 | 10/2019 |

OTHER PUBLICATIONS https://sustainablefibersolutions.com/ecosbs/.
European Patent Office, Translation of JP2013-82109 (dated Apr. 20, 2018).

* cited by examiner

HEAT-SEALABLE PAPERBOARD STRUCTURES AND ASSOCIATED PAPERBOARD-BASED CONTAINERS

PRIORITY

This application is a continuation of U.S. Ser. No. 16/390,491 filed on Apr. 22, 2019, which claims priority from U.S. Ser. No. 62/663,639 filed Apr. 27, 2018. The entire contents of U.S. Ser. No. 16/390,491 and U.S. Ser No. 62/663,639 are incorporated herein by reference.

FIELD

This application relates to heat-sealable paperboard structures and, more particularly, to containers, such as beverage containers and the like, manufactured using heat-sealable paperboard structures.

BACKGROUND

Paperboard is used in various applications. For example, coated paperboard is commonly used to manufacture various containers used in retail environments, such as beverage containers (e.g., cups), food serving containers (e.g., ice cream cups), food packaging containers (e.g., microwaveable trays) and the like. Therefore, the ability to print high-quality text and/or graphics on such containers is an important consideration for many in the industry.

Containers intended to hold beverages, whether cold beverages (e.g., iced soft-drinks or iced tea) or hot beverages (e.g., coffee or tea), present additional considerations. Cold beverages are typically served with ice and, due to humidity in the ambient air, can result in the formation of water droplets (i.e., condensation) on the external surface of the container. Such condensation, if absorbed by the container, may compromise the structural integrity of the container.

Extrusion polyethylene (PE) coated paperboard has dominated the paperboard stock used for paper or paperboard cups, with the PE layer providing not only excellent barrier to liquid such as water or beverage but also robust heat-sealability under a broad operating window. Paperboard coated with PE on both sides or only one side are being used in cups for cold beverage, ice cream, or hot drinks. For cold beverage or ice cream cups, gloss-finished PE coating layer provides higher quality print on the external side of the cups. However, PE coated cups are not easily recycled due to the difficulties in separating the polyethylene layer from the fiber substrate, which has become an increasing concern on its environmental impact.

Heat-sealable, high liquid-barrier aqueous coatings have been under development potentially for cup applications; however, the coated paperboard structures are not optimized to get the performance close to PE coated cups thus have not been successfully or widely commercialized in the market. In addition to achieve excellent barrier properties and heat-sealability, another key technical challenge is to meet both the requirements on print quality and barrier properties of the external surface of cups as described above. If conventional printable pigmented coatings are used for print purpose, they do not provide sufficient barrier to water from condensation. On the other hand, most heat-sealable, high barrier coatings often use a high level of binders, which results in a rough coated surface and limits the print quality.

Furthermore, due to the high binder level and thus the hot-tackiness, the barrier coatings cannot stand the temperature for calendering that is usually used to smoothen the coating surface.

Accordingly, those skilled in the art continue with research and development efforts in the field of heat-sealable paperboard structures and associated paperboard-based containers.

SUMMARY

Disclosed is a paperboard structure that includes a paperboard substrate having a first major side and a second major side, a barrier coating layer on the first major side of the paperboard substrate, a top coat on the first major side of the paperboard substrate, wherein the barrier coating layer is positioned between the paperboard substrate and the top coat, and a heat-sealable barrier coating layer on the second major side of the paperboard substrate.

Also disclosed is a container that include a side wall having an upper end portion and a lower end portion, the side wall being formed from a paperboard structure that includes a paperboard substrate having a first major side and a second major side, a barrier coating layer on the first major side of the paperboard substrate, a top coat on the first major side of the paperboard substrate, wherein the barrier coating layer is positioned between the paperboard substrate and the top coat, the top coat defining an exterior surface of the side wall, and a heat-sealable barrier coating layer on the second major side of the paperboard substrate, the heat-sealable barrier coating layer defining an interior surface of the side wall, and a bottom wall connected to the lower end portion of the side wall.

Also disclosed is a method for manufacturing a container that includes steps of (1) cutting a paperboard structure to yield a blank having a first end opposed from a second end, the paperboard structure including a paperboard substrate having a first major side and a second major side, a barrier coating layer on the first major side of the paperboard substrate, a top coat on the first major side of the paperboard substrate, wherein the barrier coating layer is positioned between the paperboard substrate and the top coat, and a heat-sealable barrier coating layer on the second major side of the paperboard substrate; (2) wrapping the blank around a mandrel; (3) heat-sealing the first end of the blank to the second end of the blank, thereby yielding a side wall having an upper end portion and a lower end portion; and (4) connecting a bottom wall to the lower end portion of the side wall.

Other aspects of the disclosed heat-sealable paperboard structures and associated paperboard-based containers will become apparent from the following detailed description, the accompanying drawings and the appended claims.

DETAILED DESCRIPTION

It has now been discovered that a paperboard-based container having an exterior surface with high water barrier properties and excellent printability (smoothness) can be achieved by positioning the barrier coating layer on the exterior side of the underlying paperboard substrate, which has traditionally formed the exterior surface of the container, beneath a lower-binder, calenderable, printable top coat (i.e., the barrier coating layer is positioned between the paperboard substrate and the top coat). Heat-sealability is provided by a heat-sealable barrier coating layer defining the interior surface of the container. Such a container may be particularly well-suited for holding cold beverages (e.g., iced soft-drinks) and/or cold foodstuffs (e.g., ice cream).

Figure 1:
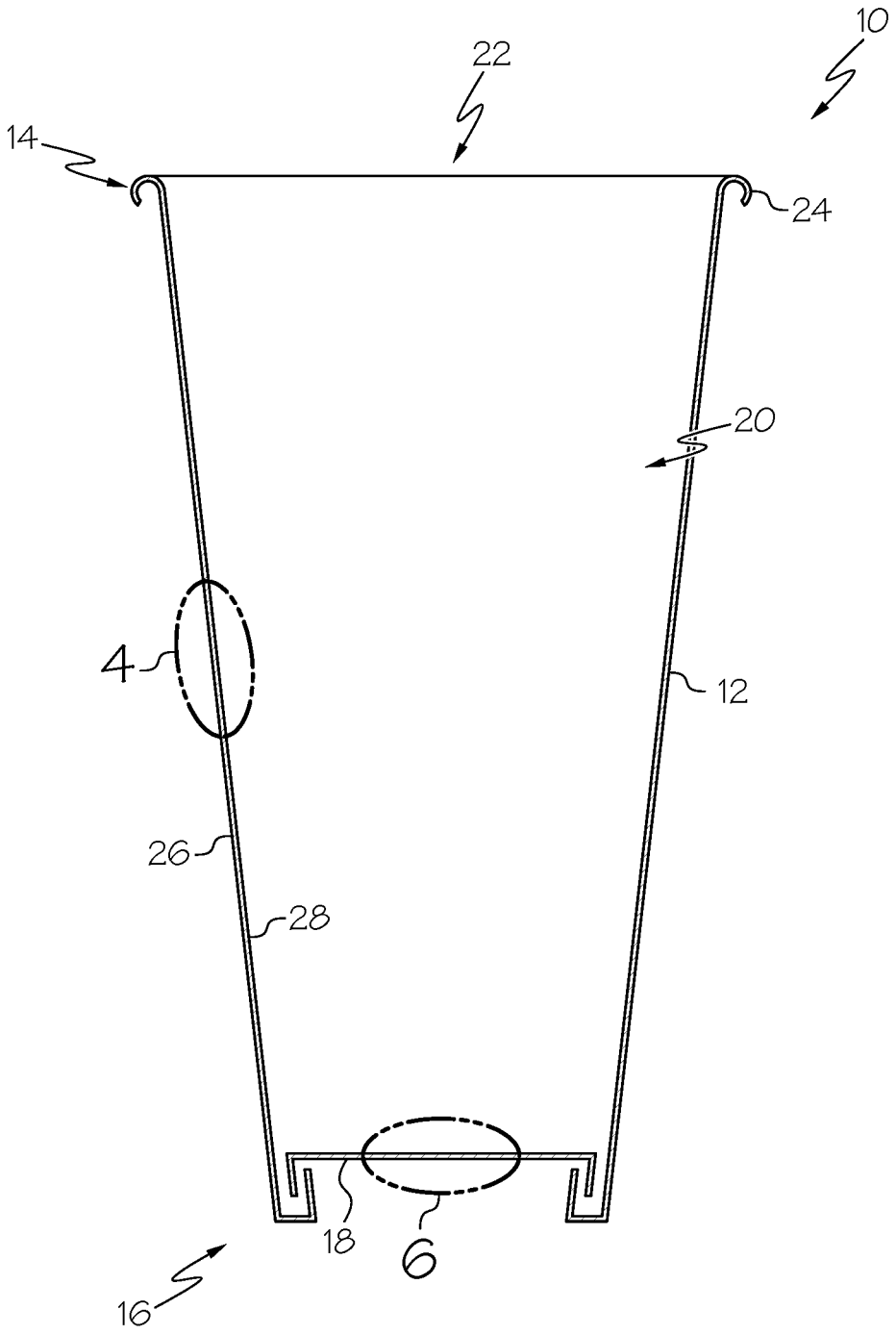
FIG. 1 is an elevational view, in section, of one aspect of the disclosed paperboard-based container.
Figure 2:
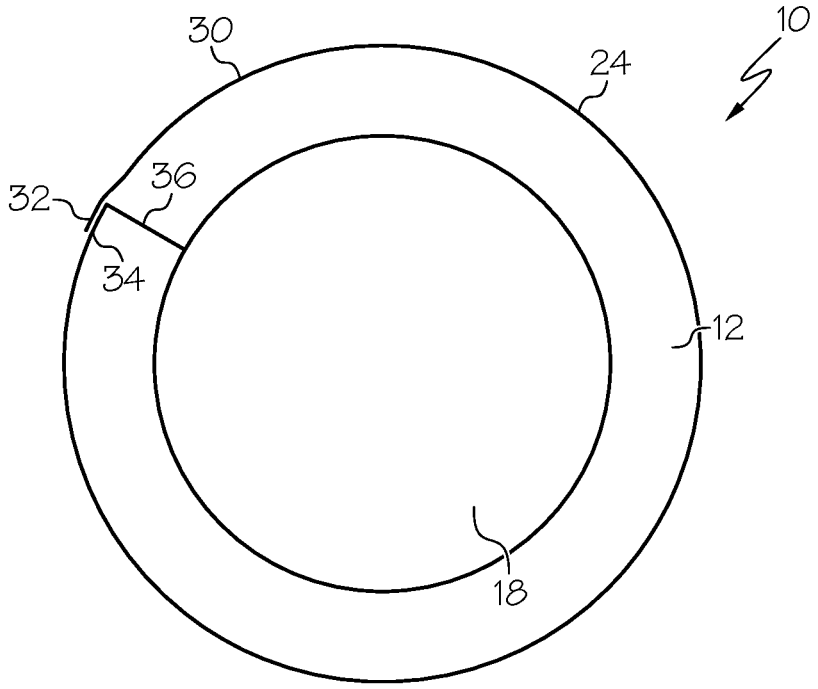
FIG. 2 is a top plan view of the paperboard-based container of FIG. 1.

Referring to FIGS. 1 and 2, one aspect of the disclosed paperboard-based container, generally designated 10, may include a side wall 12 having an upper end portion 14 and a lower end portion 16, and a bottom wall 18 connected (e.g., heat-sealed) to the lower end portion 16 of the side wall 12, thereby defining an internal volume 20 within the container 10. The upper end portion 14 of the side wall 12 may define an opening 22 into the internal volume 20. Optionally, the upper end portion 14 of the side wall 12 may additionally include a lip 24 (e.g., a rolled lip), such as for securing a lid (not shown) or the like to the container 10.

While the container 10 is shown in FIG. 1 as a tall cup (e.g., a 12-ounce, 16-ounce, 21-ounce or 24-ounce disposable take-out cup) having a frustoconical side wall 12, those skilled in the art will appreciate that the disclosed container 10 may be formed in various shapes, sizes and configurations, and may be formed with fewer or more walls than the side and bottom walls 12, 18 discussed above, without departing from the scope of the present disclosure.

Figure 3:
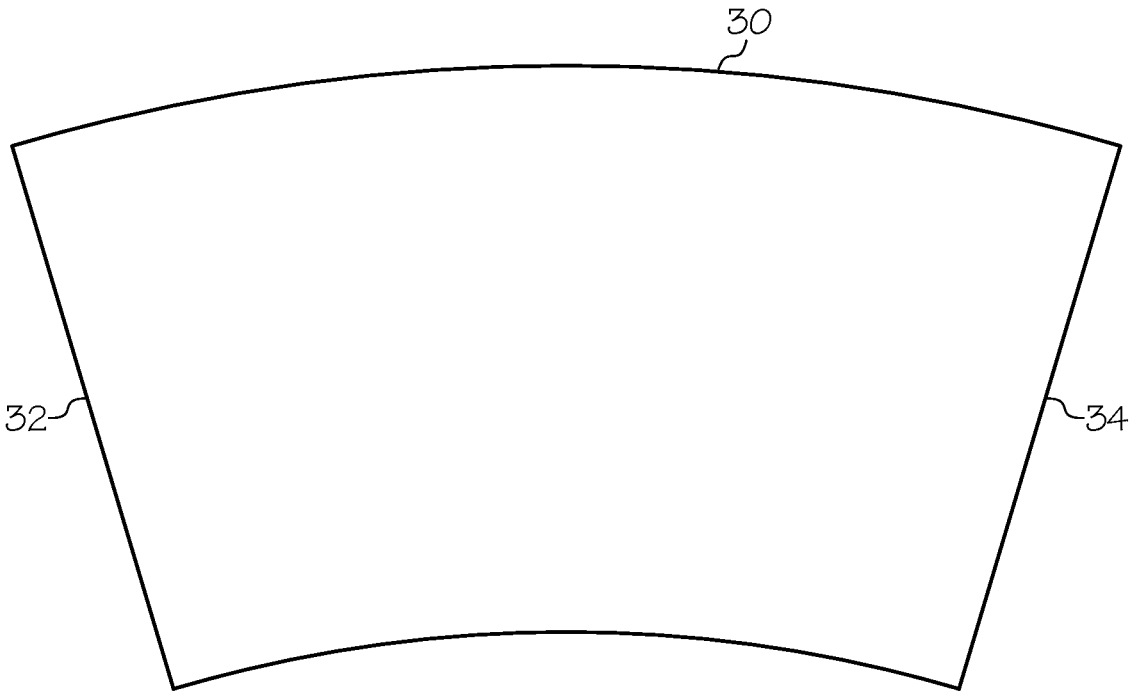
FIG. 3 is a plan view a die-cut blank that may be wrapped around a mandrel to form the side wall of the paperboard-based container of FIG. 1.

As shown in FIG. 2, the side wall 12 of the container 10 may be assembled from a blank 30 (FIG. 3) that has been cut to the desired silhouette and then wrapped around a mandrel (not shown). While the blank 30 is wrapped around the mandrel, the first end 32 of the blank 30 overlaps a second end 34 of the blank 30, and the overlapping ends 32, 34 may be connected (e.g., by heat-sealing), thereby defining a seam 36 that extends from the upper end portion 14 to the lower end portion 16 of the side wall 12. Once the side wall 12 has been assembled, the bottom wall 18 may be connected (e.g., heat-sealed) to the lower end portion 16 of the side wall 12, thereby yielding the container 10.

Figure 4:
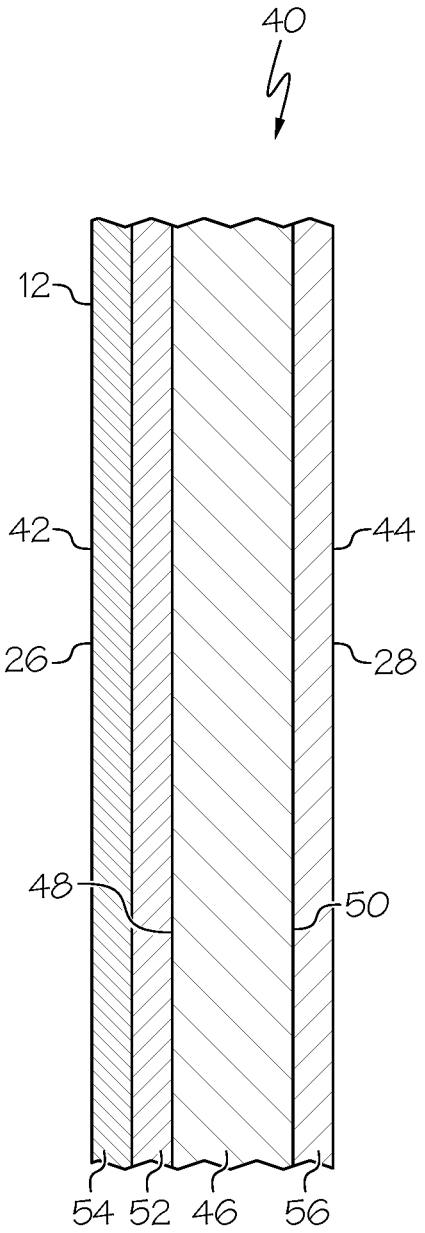
FIG. 4 is a cross-sectional view of the heat-sealable paperboard structure forming the side wall of the paperboard-based container of FIG. 1.

Referring to FIG. 4, the side wall 12 of the container 10 may be formed from a paperboard structure 40 having a first major surface 42 and a second major surface 44. The first major surface 42 of the paperboard structure 40 may correspond to the exterior surface 26 of the container 10. The second major surface 44 of the paperboard structure 40 may correspond to the interior surface 28 of the container 10.

The paperboard structure 40 may be a layered structure that includes a paperboard substrate 46 having a first major side 48 and a second major side 50. A barrier coating layer 52 and a top coat 54 may be applied to the first major side 48 of the paperboard substrate 46. The barrier coating layer 52 may be positioned between the top coat 54 and the paperboard substrate 46. The top coat 54 may define the first major surface 42 of the paperboard structure 40 and, thus, the exterior surface 26 of the container 10. A heat-sealable barrier coating layer 56 may be applied to the second major side 50 of the paperboard substrate 46. The heat-sealable barrier coating layer 56 may define the second major surface 44 of the paperboard structure 40 and, thus, the interior surface 28 of the container 10.

Figure 5:
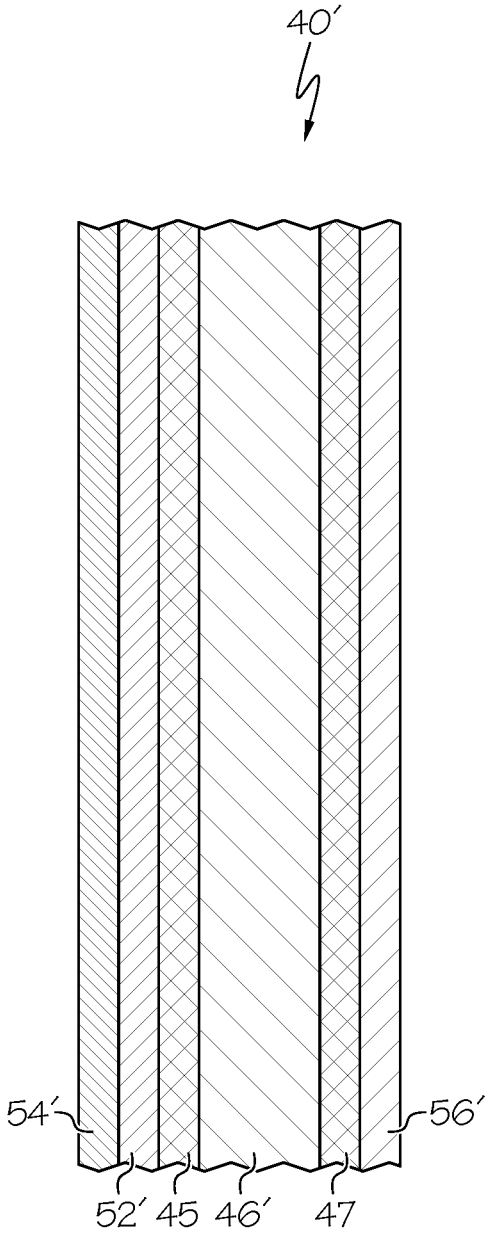
FIG. 5 is a cross-sectional view of a heat-sealable paperboard structure that may be used as an alternative to the heat-sealable paperboard structure shown in FIG. 4.

At this point, those skilled in the art will appreciate that various additional layers may be incorporated into the paperboard structure 40, whether between the paperboard substrate 46 and the top coat 54 and/or between the paperboard substrate 46 and the heat-sealable barrier coating layer 56, without departing from the scope of the present disclosure. In one variation, as shown in FIG. 5, the paperboard structure 40' may include a basecoat 45 between the paperboard substrate 46' and the barrier coating layer 52'. In another variation, as shown in FIG. 5, the paperboard structure 40' may include a basecoat 47 between the paperboard substrate 46' and the heat-sealable barrier coating layer 56'. In yet another variation, as shown in FIG. 5, the paperboard structure 40' may include a first basecoat 45 between the paperboard substrate 46' and the barrier coating layer 52' and a second basecoat 47 between the paperboard substrate 46' and the heat-sealable barrier coating layer 56'.

Referring back to FIG. 4, the paperboard substrate 46 of the paperboard structure 40 may be (or may include) any cellulosic material that is capable of being coated with the barrier coating layer 52, the top coat 54 and the heat-sealable barrier coating layer 56. Those skilled in the art will appreciate that the paperboard substrate 46 may be bleached or unbleached. Examples of appropriate paperboard substrates include corrugating medium, linerboard, solid bleached sulfate (SBS) and coated unbleached kraft.

The paperboard substrate 46 may have an uncoated basis weight of at least about 40 pounds per 3000 $ft^2$. In one expression the paperboard substrate 46 may have an uncoated basis weight ranging from about 40 pounds per 3000 $ft^2$ to about 300 pounds per 3000 $ft^2$. In another expression the paperboard substrate 46 may have an uncoated basis weight ranging from about 85 pounds per 3000 $ft^2$ to about 300 pounds per 3000 $ft^2$. In another expression the paperboard substrate 46 may have an uncoated basis weight ranging from about 85 pounds per 3000 $ft^2$ to about 250 pounds per 3000 $ft^2$. In yet another expression the paperboard substrate 46 may have an uncoated basis weight ranging from about 100 pounds per 3000 $ft^2$ to about 250 pounds per 3000 $ft^2$.

Furthermore, the paperboard substrate 46 may have a caliper (thickness) ranging, for example, from about 4 points to about 30 points (0.004 inch to 0.030 inch). In one expression, the caliper range is from about 8 points to about 24 points. In another expression, the caliper range is from about 13 points to about 18 points.

One specific, nonlimiting example of a suitable paperboard substrate 46 is 13-point SBS cupstock manufactured by WestRock Company of Atlanta, Ga. Another specific, nonlimiting example of a suitable paperboard substrate 46 is 18-point SBS cupstock manufactured by WestRock Company.

The barrier coating layer 52 may be applied to the first major side 48 of the paperboard substrate 46 using any suitable method, such as one or more coaters either on the paper machine or as off-machine coater(s). The barrier coating layer 52 may be applied to the paperboard substrate 46 at various coat weights. In one expression, the barrier coating layer 52 may be applied at a coat weight of about 2 to 20 pounds per 3,000 square feet. In one expression, the barrier coating layer 52 may be applied at a coat weight of about 5 to 16 pounds per 3,000 square feet. In another expression, the barrier coating layer 52 may be applied at a coat weight of about 8 to 12 pounds per 3,000 square feet.

The barrier coating layer 52 may include a binder and a pigment. In one expression, the ratio of the binder to the pigment can be at least about 1:2 by weight. In another expression, the ratio of the binder to the pigment can be about 1:2 to about 9:1 by weight. In another expression, the ratio of the binder to the pigment can be about 1:1 to about 4:1 by weight. In yet another expression, the ratio of the binder to the pigment can be at least about 1:1 by weight.

In one particular implementation, the binder of the barrier coating layer 52 may be an aqueous binder. As one general, non-limiting example, the binder may be styrene-acrylate (SA). As another general, non-limiting example, the binder may be a mixture of binders that includes styrene-acrylate (SA). Several specific, non-limiting examples of suitable binders are presented in Table 2. Other aqueous binders are also contemplated, such as styrene-butadiene rubber (SBR), ethylene acrylic acid (EAA), polyvinyl acetate (PVAC), polyvinyl acrylic, polyester dispersion, and combinations thereof.

The pigment component of the barrier coating layer 52 may be (or may include) various materials. Several non-limiting examples of suitable pigments are presented in Table 1. Other pigments, such as plastic pigments, titanium dioxide pigment, talc pigment and the like, may be used without departing from the scope of the present disclosure.

In one variation, the pigment component of the barrier coating layer 52 may be a clay pigment. As one example, the clay pigment may be kaolin clay, such as a fine kaolin clay. As another example, the clay pigment may be platy clay, such as a high aspect ratio platy clay (e.g., aspect ratio of at least 40:1).

In another variation, the pigment component of the barrier coating layer 52 may be a calcium carbonate ($CaCO_3$) pigment. As one example, the $CaCO_3$ pigment can be a coarse ground $CaCO_3$ with a particle size distribution wherein about 60 percent of the particles are less than 2 microns. As another example, the $CaCO_3$ pigment can be a fine ground $CaCO_3$ with a particle size distribution wherein about 90 percent of the particles are less than 2 microns. As yet another example, the $CaCO_3$ pigment can be a fine ground $CaCO_3$ with a mean particle size of about 0.4 microns.

In yet another variation, the pigment component of the barrier coating layer 52 may be a pigment blend that includes both calcium carbonate pigment and clay pigment.

The top coat 54 may be applied to the barrier coating layer 52 using any suitable method, such as one or more coaters either on the paper machine or as off-machine coater(s). The top coat 54 may be applied to the barrier coating layer 52 at various coat weights. In one expression, the top coat 54 may be applied at a coat weight of about 1 to 10 pounds per 3,000 square feet. In another expression, the top coat 54 may be applied at a coat weight of about 2 to 8 pounds per 3,000 square feet. In yet another expression, the top coat 54 may be applied at a coat weight of about 3 to 6 pounds per 3,000 square feet.

The top coat 54 may include a binder and a pigment. The pigments and binders useful for the barrier coating layer 52 may also be used in the top coat 54. However, the binder-to-pigment ratio of the top coat 54 may be significantly different from the binder-to-pigment ratio of the barrier coating layer 52. In one expression, the ratio of the binder to the pigment in the top coat 54 can be about 1:1 to about 1:10 by weight. In another expression, the ratio of the binder to the pigment in the top coat 54 can be about 1:2 to about 1:8 by weight. In yet another expression, the ratio of the binder to the pigment in the top coat 54 can be about 1:2.5 to about 1:5 by weight.

The heat-sealable barrier coating layer 56 may be applied to the second major side 50 of the paperboard substrate 46 using any suitable method, such as one or more coaters either on the paper machine or as off-machine coater(s). The heat-sealable barrier coating layer 56 may be heat-sealable. When heated, a heat-seal coating provides an adhesion to other regions of product with which it contacts.

The heat-sealable barrier coating layer 56 may be applied to the paperboard substrate 46 at various coat weights. In one expression, the heat-sealable barrier coating layer 56 may be applied at a coat weight of about 2 to 20 pounds per 3,000 square feet. In another expression, the heat-sealable barrier coating layer 56 may be applied at a coat weight of about 5 to 16 pounds per 3,000 square feet. In yet another expression, the heat-sealable barrier coating layer 56 may be applied at a coat weight of about 8 to 12 pounds per 3,000 square feet.

The heat-sealable barrier coating layer 56 may include a binder and a pigment. The pigments and binders useful for the barrier coating layer 52 may also be used in the heat-sealable barrier coating layer 56. However, those skilled in the art will appreciate that the heat-sealable barrier coating layer 56 will require a certain minimum amount of binder to be heat-sealable. In one expression, the ratio of the binder to the pigment in the heat-sealable barrier coating 56 can be at least about 1:1 by weight. In another expression, the ratio of the binder to the pigment in the heat-sealable barrier coating 56 can be at least about 2:1 by weight. In another expression, the ratio of the binder to the pigment in the heat-sealable barrier coating 56 can be at least about 3:1 by weight. In another expression, the ratio of the binder to the pigment in the heat-sealable barrier coating 56 can be about 1:2 to about 9:1 by weight. In yet another expression, the ratio of the binder to the pigment in the heat-sealable barrier coating 56 can be about 1:1 to about 4:1 by weight. In yet another expression, the ratio of the binder to the pigment can be at least about 1:1 by weight.

Referring back to FIG. 1, the bottom wall 18 of the container 10 may be formed from a paperboard structure, such as the paperboard structure 40 shown in FIG. 4 or the paperboard structure 40' shown in FIG. 5. However, various other paperboard structures may be used to form the bottom wall 18, such as when printability of the bottom wall 18 is of little or no concern.

Figure 6:
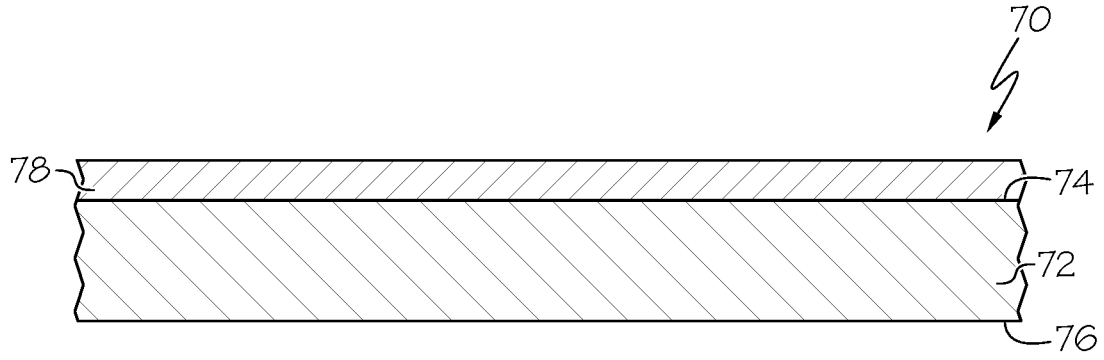
FIG. 6 is a cross-sectional view of the paperboard structure forming the bottom wall of the paperboard-based container of FIG. 1.

As shown in FIG. 6, in one variation, the bottom wall 18 (FIG. 1) of the container 10 (FIG. 1) may be formed from a paperboard structure 70 that includes a paperboard substrate 72 having a first major side 74 and a second major side 76. A single barrier coating layer 78 may be applied to the first major side 74 of the paperboard substrate 72.

Figure 7:
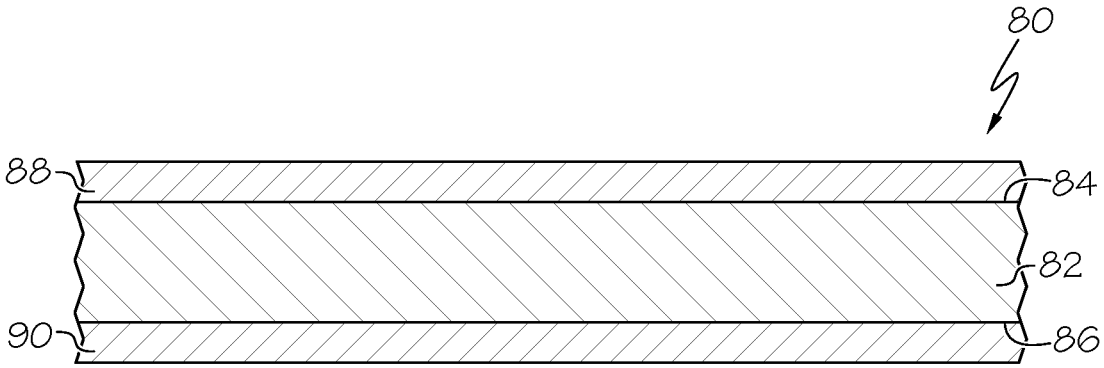
FIG. 7 is a cross-sectional view of a paperboard structure that may be used as one alternative to the paperboard structure shown in FIG. 6.

As shown in FIG. 7, in another variation, the bottom wall 18 (FIG. 1) of the container 10 (FIG. 1) may be formed from a paperboard structure 80 that includes a paperboard substrate 82 having a first major side 84 and a second major side 86. A first barrier coating layer 88 may be applied to the first major side 84 of the paperboard substrate 82 and a second barrier coating layer 90 may be applied to the second major side 86 of the paperboard substrate 82.

Figure 8:
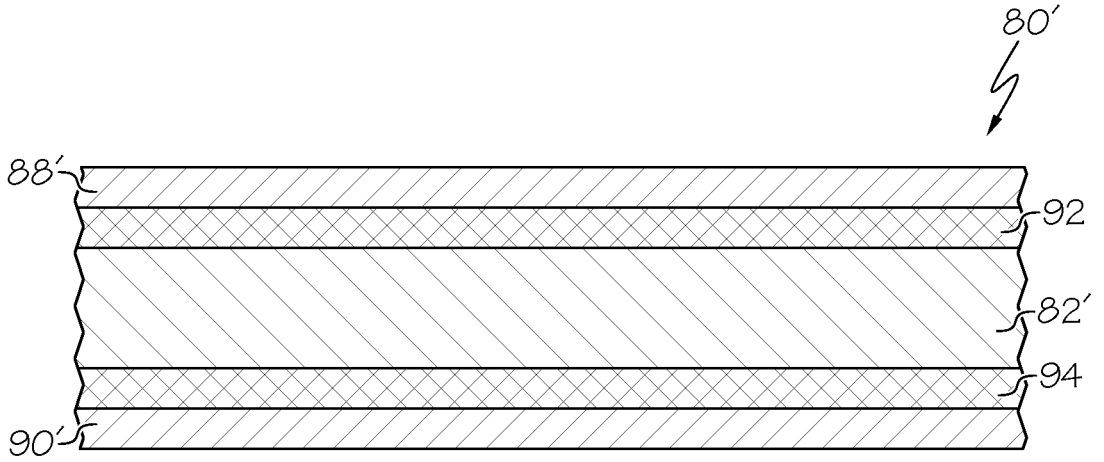
FIG. 8 is a cross-sectional view of a paperboard structure that may be used as another alternative to the paperboard structure shown in FIG. 6.

At this point, those skilled in the art will appreciate that various additional layers may be incorporated into the paperboard structures used to form the bottom wall 18, without departing from the scope of the present disclosure. For example, as shown in FIG. 8, the paperboard structure 80' may include a first basecoat 92 between the paperboard substrate 82' and the first barrier coating layer 88' and/or a second basecoat 94 between the paperboard substrate 82' and the second barrier coating layer 90'.

EXAMPLES

Examples 1-16

Experiments were conducted to evaluate the use of a top coat over the barrier coating layer of a paperboard structure. Four barrier coating formulations (BC1-BC4) and five top coat formulations (TC1-TC5) were prepared and used in the experiments. The pigments used in the formulations are presented in Table 1. The binders used in the formulations are presented in Table 2. The barrier coating formulations (BC1-BC4) are presented in Table 3. The top coat formulations (TC1-TC5) are presented in Table 4.

TABLE 1

| Name | Pigment | Description |
|---|---|---|
| CL-1 | HYDRAFINE ® 90 W (KaMin LLC of Macon, Georgia) | kaolin clay No. 1 ultrafine clay |
| CL-2 | BARRISURF ™ HX (IMERYS Kaolin, Georgia) | platy clay with high aspect ratio |
| CC-1 | HYDROCARB ® 60 (Omya AG of Oftringen, Switzerland) | Coarse ground $CaCO_3$ (particle size 60% < 2 micron) |
| CC-2 | HYDROCARB ® 90 (Omya AG) | fine ground $CaCO_3$ (particle size 90% < 2 micron) |
| HSP-1 | ROPAQUE ™ AF-1353 (The Dow Chemical Company) | styrene acrylic polymeric pigment (1.3 μm particle size, 53% void volume) |

TABLE 2

| Supplier | Binder | Glass Transition (Tg, ° C.) |
|---|---|---|
| The Dow Chemical Company | RHOPLEX ™ C-340 (also known as "SA-1") | 8 |
| Archroma | CARTASEAL ® SCR (also known as "SA-2") | 30 |

TABLE 3

| Formulation (in Parts) | Barrier Coating BC-1 | BC-2 | BC-3 | BC-4 |
|---|---|---|---|---|
| $CaCO_3$ (CC-1) | 50 | 62.8 | 62.8 | 65 |
| $CaCO_3$ (CC-2) | | | | |
| Clay (CL-1) | | 31.4 | | |
| Clay (CL-2) | 50 | | 31.4 | 35 |
| Hollow Sphere Pigment (HSP-1) | | 5.8 | 5.8 | |
| Binder (SA-1) | | | | |
| Binder (SA-2) | 100 | 200 | 200 | 200 |

TABLE 4

| Formulation (in Parts) | Top Coat TC-1 | TC-2 | TC-3 | TC-4 | TC-5 |
|---|---|---|---|---|---|
| $CaCO_3$ (CC-1) | | | | | |
| $CaCO_3$ (CC-2) | 50 | 50 | 50 | 50 | 50 |
| Clay (CL-1) | 50 | 50 | 50 | 50 | 50 |
| Clay (CL-2) | | | | | |
| Hollow Sphere Pigment (HSP-1) | | | | | |
| Binder (SA-1) | | 35 | | | 25 |
| Binder (SA-2) | 35 | | 25 | 20 | |

The formulations were applied at various coat weights to 18-point solid bleached sulfate cupstock having a basis weight of 185 pounds per 3000 square feet. A blade coater was used to apply the barrier coating formulation to the wire side of the paperboard substrate. A blade coater was again used to apply the top coat formulation to the barrier coating layer, thereby yielding a two-layer coating on the wire side of the paperboard substrate. Examples 1, 4, 7 and 12 did not receive the top coat formulation and are being presented for comparison purposes. The examples and experimental results (Water Cobb; Parker Print Surf Smoothness; ink density; and blocking rating) are shown in Tables 5 and 6.

TABLE 5

| Example | 1 | 2 | 3 | 4 | 5 | 6 | 7 | 8 |
|---|---|---|---|---|---|---|---|---|
| Barrier Coating | BC-1 | | | BC-2 | | | BC-3 | |
| Barrier Coating Weight (lb/3000 $ft^2$) | 12 | | | 9.6 | | | 10.2 | |
| Top Coat | None | TC-1 | | None | TC-2 | | None | TC-1 |
| Top Coat Weight (lb/3000 $ft^2$) | 0 | 3.2 | 4.2 | 0 | 4.3 | 6.2 | 0 | 4.2 |
| $H_2O$ Cobb ($g/m^2$-30 min) | 28.5 | 23.3 | 19.3 | 31.8 | 20.8 | 17.1 | 10.6 | 10.9 |
| PPS (μm) | 4.72 | 2.2 | 2.33 | 4.78 | 2.77 | 2.68 | 6.37 | 2.26 |
| Ink Density | | | | | | | 1.52 | 1.68 |
| Blocking Rating (50° C./60 psi/24 h) | 1.5 | 0.3 | 0.2 | 1.5 | 0.3 | 0.3 | 1.5 | 0 |

TABLE 6

| Example | 9 | 10 | 11 | 12 | 13 | 14 | 15 | 16 |
|---|---|---|---|---|---|---|---|---|
| Barrier Coating | BC-3 | | | | BBC-4 | | | |
| Barrier Coating Weight (lb/3000 $ft^2$) | 10.2 | | | | 11.7 | | | |
| Top Coat | TC-3 | TC-4 | TC-5 | None | TC-1 | TC-3 | TC-4 | TC-5 |
| Top Coat Weight (lb/3000 $ft^2$) | 2.3 | 3.6 | 3.5 | 0 | 6.2 | 5.7 | 5.5 | 5 |
| $H_2O$ Cobb ($g/m^2$-30 min) | 14.7 | 16.3 | 11.5 | 7 | 9.1 | 7.7 | 8.8 | 6 |
| PPS (μm) | 2.07 | 2.05 | 2.32 | 6.25 | 2.45 | 2.11 | 1.97 | 2.31 |
| Ink Density | 1.27 | 1.11 | 1.54 | 1.56 | 1.61 | 1.41 | 1.12 | 1.54 |
| Blocking Rating (50° C./60 psi/24 h) | 0 | 0.1 | 0.1 | 1.8 | 0.1 | 0 | 0 | 0 |

Thus, using a top coat over the barrier coating layer of a paperboard structure provides a smooth, printable surface, as evidenced by the Parker Print Surface (PPS-10S) smoothness results measured according to TAPPI standard T555. All examples exhibited PPS smoothness of less than 4 microns and, indeed, less than 3 microns, with many examples exhibiting a PPS smoothness of less than 2.5 microns. Comparative Examples 1, 4, 7 and 12, which did not receive the top coat formulation, exhibited PPS smoothness of greater than 4 microns, which is not sufficient for high quality printing. The coated samples 7 to 16 were also printed on a Harper Phantom QD™ Flexo Proofing System from Harper Corporation using a 2.5 bcm anilox roll with a blue flexo ink. The ink density was measured on an X-Rite 500 series equipment. The results showed TC-1 and TC-5, with an ink density value higher than 1.5, outperformed TC-3 and TC-4. As a reference, ink density of 1.68 was measured on a commercial SBS print grade manufactured by WestRock Company.

In addition to high smoothness (printability), the examples also surprisingly exhibited excellent barrier properties, as evidenced by the 30-minute-water-Cobb results. For most cases, the additional layer of top coat improved or at least maintained the water barrier properties of the underneath barrier coating layer. All examples had 30-minute-water-Cobb ratings of less than 30 $g/m^2$, with many below 20 $g/m^2$ and several below 10 $g/m^2$.

Lastly, the blocking rating (50° C./60 psi/24 hrs), was less than 3.0 for all examples, indeed less than 2.0, and less than 1.0 for many examples. Most interestingly, the additional top coat layer significantly reduced the blocking rating (i.e., from 1.5-1.8 to 0.2-0.3) over the corresponding samples with only the barrier coating layer. Table 7 defines the blocking test rating system.

TABLE 7

| Rating | Description |
|---|---|
| 0 | Samples fall apart without any force applied |
| 1 | Samples have a light tackiness but separate without fiber tear |
| 2 | Samples have a high tackiness but separate without fiber tear |
| 3 | Samples are sticky and up to 25% fiber tear or coat damage (area basis) |
| 4 | Samples have more than 25% fiber tear or coat damage (area basis) |

Figure 9:
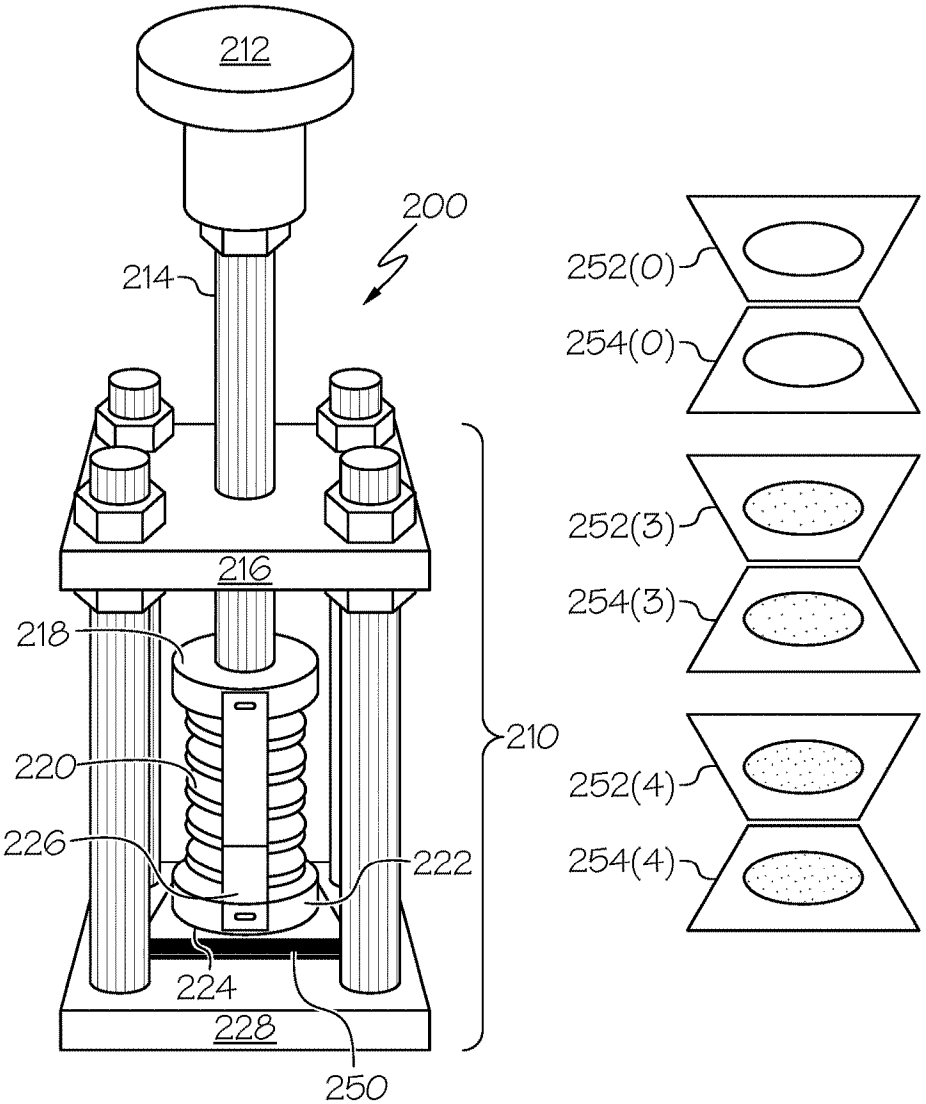
FIG. 9 is an illustration of a device for testing blocking of coated paperboard samples.
Figure 9:
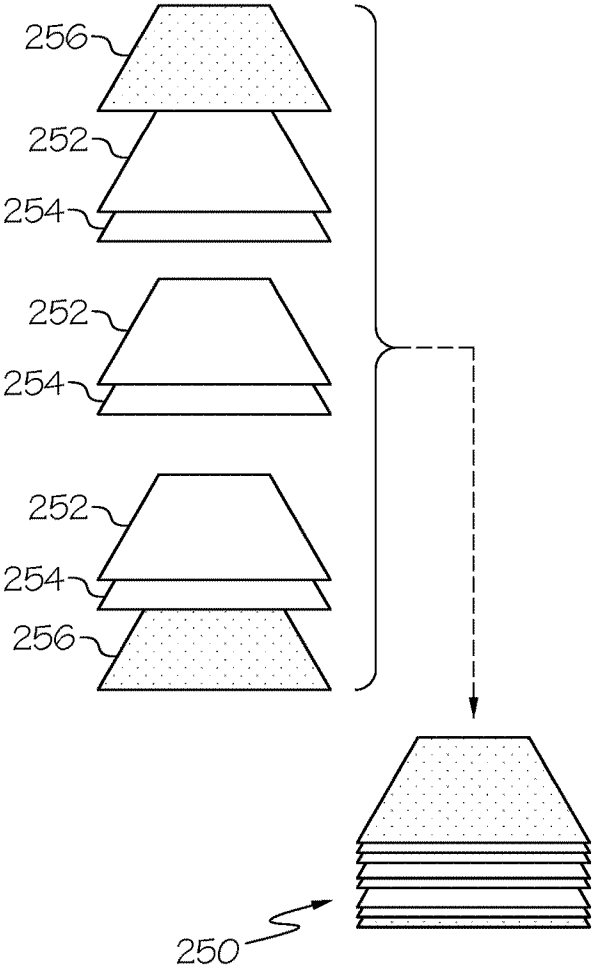

The blocking behavior of the samples was tested by evaluating the adhesion between the barrier coated side and the other uncoated side. A simplified illustration of the blocking test is shown in FIG. 9. The paperboard was cut into 2-inch by 2-inch square samples. Several duplicates were tested for each condition, with each duplicate evaluating the blocking between a pair of samples 252, 254. (For example, if four duplicates were test, four pairs—eight pieces—would be used.) Each pair was positioned with the 'barrier-coated' side of one piece 252 contacting the uncoated side of the other piece 254. The pairs were placed into a stack 250 with a spacer 256 between adjacent pairs, the spacer being foil, release paper, or even copy paper. The entire sample stack was placed into the test device 200 illustrated in FIG. 9.

The test device 200 includes a frame 210. An adjustment knob 212 is attached to a screw 214 which is threaded through the frame top 216. The lower end of screw 214 is attached to a plate 218 which bears upon a heavy coil spring 220. The lower end of the spring 220 bears upon a plate 222 whose lower surface 224 has an area of one square inch. A scale 226 enables the user to read the applied force (which is equal to the pressure applied to the stack of samples through the one-square-inch lower surface 224).

The stack 250 of samples is placed between lower surface 224 and the frame bottom 228. The knob 212 is tightened until the scale 226 reads the desired force of 100 lbf (100 psi applied to the samples) or 60 lbf (60 psi applied to the samples). The entire device 200 including samples is then placed in an oven at 50° C. for 24 hours. The device 200 is then removed from the test environment and cooled to room temperature. The pressure is then released, and the samples removed from the device.

The samples were evaluated for tackiness and blocking by separating each pair of paperboard sheets. Blocking damage is visible as fiber tear, which if present usually occurs with fibers pulling up from the non-barrier surface of samples 254. If the non-barrier surface was coated with a print coating, then blocking might also be evinced by damage to the print coating.

For example, in as symbolically depicted in FIG. 9, samples 252(0)/254(0) might be representative of a "0" rating (no blocking). The circular shape in the samples indicates an approximate area that was under pressure, for instance about one square inch of the overall sample. Samples 252(3)/254(3) might be representative of a "3" blocking rating, with up to 25% fiber tear in the area that was under pressure, particularly in the uncoated surface of sample 254(3). Samples 252(4)/254(4) might be representative of a "4" blocking rating with more than 25% fiber tear, particularly in the uncoated surface of sample 254(4). The depictions in FIG. 9 are only meant to approximately suggest the percent damage to such test samples, rather than showing a realistic appearance of the samples.

Examples 17-21

Additional experiments were conducted to evaluate paperboard structures suitable for manufacturing paperboard-based containers (e.g., cups). Specifically, these experiments evaluated the use of a top coat over the barrier coating layer on the first major side of a paperboard substrate and a heat-sealable barrier coating layer on the second major side of the paperboard substrate, as shown in FIG. 4. Two barrier coating formulations (BC3 and BC5) and one top coat formulation (TC5) were prepared and used in the experiments. The pigments used in the formulations are presented in Table 1. The binders used in the formulations are presented in Table 2. The barrier coating formulations (BC3 and BC5) and the top coat formulation (TC5) are presented in Table 8.

TABLE 8

| Formulation | Barrier Coating | | Top Coat |
|---|---|---|---|
| (in Parts) | BC-3 | BC-5 | TC-5 |
| $CaCO_3$ (CC-1) | 62.8 | 62.8 | |
| $CaCO_3$ (CC-2) | | | 50 |
| Clay (CL-1) | | | 50 |
| Clay (CL-2) | 31.4 | 31.4 | |
| Hollow Sphere Pigment (HSP-1) | 5.8 | 5.8 | |
| Binder (SA-1) | | | 25 |
| Binder (SA-2) | 200 | 300 | |

The formulations were applied at various coat weights to solid bleached sulfate cupstock. The wire side of the cupstock (the "first major side") received the barrier coating layer and the top coat. The felt side of the cupstock (the "second major side") received the heat-sealable barrier coating layer. The examples and experimental results (Water Cobb; Parker Print Surf Smoothness; and repulpability) are shown in Table 9. Examples 17 and 20 are comparative examples (no top coat was used). Specifically, example 17 that only had a heat-sealable barrier coating on the felt side was used to form cup containers suitable for hot beverages such as coffee, where the cup containers do not need external barrier and/or printable coatings and thus are usually printed on a non-coated external surface.

TABLE 9

| Example Description | 17 Side Wall | | 18 Side Wall | | 19 Side Wall | | 20 Bottom Wall | | 21 Bottom Wall | |
|---|---|---|---|---|---|---|---|---|---|---|
| Substrate | 18 pt, 185 lb/3000F2, SBS cupstock | | | | 13 pt, 150 lb/3000F2, SBS cupstock | | | | | |
| Surface (side) | Felt | Wire | Felt | Wire | Felt | Wire | Felt | Wire | Felt | Wire |
| Barrier Coating | BC-5 | none | BC-5 | BC-5 | BC-5 | BC-3 | BC-5 | BC-5 | BC-5 | BC-3 |
| Barrier Coating Weight (lb/3000 $ft^2$) | 11.4 | | 13 | 9.9 | 9.3 | 10.1 | 9.8 | 11.7 | 10 | 9.3 |
| Top Coat | none | none | none | TC-5 | none | TC-5 | none | none | none | TC-5 |
| Top Coat Weight (lb/3000 $ft^2$) | | | | 3 | | 2.8 | | | | 2.9 |
| $H_2O$ Cobb ($g/m^2$-30 min) | 5.7 | | 7 | 10.8 | 4.8 | 13.9 | 3.6 | 15.5 | 3.8 | 11 |
| PPS-BC (μm) | 3.49 | | | 4.65 | | 4.72 | | | | 4.49 |
| PPS-BC/TC (μm) | | | | 2.63 | | 2.46 | | | | 2.37 |
| Blocking Rating (50° C./60 psi/24 h) | 1.7 | | | | 2.4 | | 4.0 | | 2.5 | |
| Repulpability (% accepts) | 93.2 | | 84.0 | | 85.0 | | 81.1 | | 80.4 | |

Excellent barrier properties and smoothness were again observed for the examples that included a top coat over the barrier coating layer. Using combinations of any one of the sidewall examples and any one of the bottom wall examples, cups were all successfully formed on a PMC (Paper Machinery Corporation) cup machine, model PMC-1250, with 100% fiber tears upon tearing apart the heat-sealed seams. All cups also held liquid including coffee, cola, and water very well without leakage.

The samples with a barrier coat and a top coat on the wire side of the board (the "first major side") and a heat-sealable barrier coating on the felt side of the board (the "second major side") showed a blocking rating (50° C./60 psi/24 hrs) of less than 3.0, which was more than 1 level lower than the sample (e.g., 20) that did not have a top coat.

Repulpability was tested using an AMC Maelstom repulper. 110 grams of coated paperboard, cut into 1-inch by 1-inch squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006-inch slot size). Rejects (caught by the screen) and fiber accepts were collected, dried and weighed. The percentage of accepts was calculated based on the weights of accepts and rejects, with 100% being complete repulpability. All the samples exhibited a repulpability of at least 80 percent, and some exhibited a repulpability of at least 85 percent.

Although various aspects of the disclosed heat-sealable paperboard structures and associated paperboard-based containers have been shown and described, modifications may occur to those skilled in the art upon reading the specification. The present application includes such modifications and is limited only by the scope of the claims.

What is claimed is:

1. A paperboard structure comprising:

a paperboard substrate having a first major side and a second major side;

a barrier coating layer on the first major side of the paperboard substrate, the barrier coating layer comprising a barrier coating binder and a barrier coating pigment at a first binder-to-pigment ratio;

a top coat on the first major side of the paperboard substrate, the top coat comprising a top coat binder and a top coat pigment at a second binder-to-pigment ratio, wherein the first binder-to-pigment ratio is greater than the second binder-to-pigment ratio, and wherein the barrier coating layer is positioned between the paperboard substrate and the top coat, the top coat defining an outermost surface of the first major side of the paperboard structure; and a heat-sealable barrier coating layer on the second major side of the paperboard substrate, the heat-sealable barrier coating layer defining an outermost surface of the second major side of the paperboard structure, wherein the heat-sealable barrier coating layer comprises an aqueous binder.

2. The paperboard structure of claim 1 wherein the first binder-to-pigment ratio is at least 1:2, by weight.

3. The paperboard structure of claim 1 wherein the second binder-to-pigment ratio ranges from 1:1 to 1:10.

4. The paperboard structure of claim 1 wherein the barrier coating layer has a coat weight ranging from 2 lb/3000 $ft^2$ to 20 lb/3000 $ft^2$.

5. The paperboard structure of claim 1 wherein the barrier coating binder comprises at least one of styrene-acrylate, styrene-butadiene rubber, ethylene acrylic acid, polyvinyl acetate, polyvinyl acrylic, and polyester dispersion.

6. The paperboard structure of claim 1 wherein the barrier coating pigment comprises at least one of a clay pigment, a $CaCO_3$ pigment, a plastic pigment, a titanium dioxide pigment, and a talc pigment.

7. The paperboard structure of claim 1 wherein the top coat has a coat weight ranging from 1 lb/3000 $ft^2$ to 10 lb/3000 $ft^2$.

8. The paperboard structure of claim 1 wherein the second binder-to-pigment ratio is 1:2 to 1:8, by weight.

9. The paperboard structure of claim 1 wherein the top coat binder comprises at least one of styrene-acrylate, styrene-butadiene rubber, polyvinyl acetate, polyvinyl acrylic, ethylene acrylic acid, and polyester dispersion.

10. The paperboard structure of claim 1 wherein the top coat pigment comprises at least one of clay pigment and calcium carbonate pigment.

11. The paperboard structure of claim 1 wherein the heat-sealable barrier coating layer has a coat weight ranging from 2 lb/3000 $ft^2$ to 20 lb/3000 $ft^2$.

12. The paperboard structure of claim 1 wherein the heat-sealable barrier coating layer further comprises a heat-sealable barrier coating pigment.

13. The paperboard structure of claim 12 wherein a heat-sealable barrier coating ratio of the binder to the pigment is at least 1:1, by weight.

14. The paperboard structure of claim 12 wherein the heat-sealable barrier coating pigment comprises at least one of a clay pigment, a $CaCO_3$ pigment, a plastic pigment, a titanium dioxide pigment, and a talc pigment.

15. A container comprising:

a side wall having an upper end portion and a lower end portion; and a bottom wall connected to the lower end portion of the side wall, wherein at least one of side wall and the bottom wall is formed from a paperboard structure comprising:

a paperboard substrate having a first major side and a second major side;

a barrier coating layer on the first major side of the paperboard substrate, the barrier coating layer comprising a barrier coating binder and a barrier coating pigment at a first binder-to-pigment ratio of at least 1:2, by weight;

a top coat on the first major side of the paperboard substrate, the top coat comprising a top coat binder and a top coat pigment at a second binder-to-pigment ratio ranging from 1:1 to 1:10, wherein the first binder-to-pigment ratio is greater than the second binder-to-pigment ratio, and wherein the barrier coating layer is positioned between the paperboard substrate and the top coat, the top coat defining an exterior surface of the bottom wall; and a heat-sealable barrier coating layer applied to the second major side of the paperboard substrate, the heat-sealable barrier coating layer defining an interior surface of the bottom wall, wherein the heat-sealable barrier coating layer comprises an aqueous binder.

16. The container of claim 15 further comprising one or more basecoat layers positioned between the paperboard substrate and the barrier coating layer.

17. The container of claim 16 wherein the basecoat layers contain one or more barrier coating layers.

18. The container of claim 15 wherein the heat-sealable barrier coating layer further comprises a heat-sealable barrier coating pigment.

19. The container of claim 15 wherein the top coat is calendered.

20. A method for manufacturing a container comprising:

cutting a paperboard structure to yield a blank having a first end opposed from a second end, the paperboard structure comprising:

a paperboard substrate having a first major side and a second major side;

a barrier coating layer on the first major side of the paperboard substrate, the barrier coating layer comprising a barrier coating binder and a barrier coating pigment at a first binder-to-pigment ratio of at least 1:2, by weight;

a top coat on the first major side of the paperboard substrate, the top coat comprising a top coat binder and a top coat pigment at a second binder-to-pigment ratio ranging from 1:1 to 1:10, wherein the first binder-to-pigment ratio is greater than the second binder-to-pigment ratio, and wherein the barrier coating layer is positioned between the paperboard substrate and the top coat; and a heat-sealable barrier coating layer applied to the second major side of the paperboard substrate, wherein the heat-sealable barrier coating layer comprises an aqueous binder;

wrapping the blank around a mandrel;

heat-sealing the first end of the blank to the second end of the blank, thereby yielding a side wall having an upper end portion and a lower end portion; and connecting a bottom wall to the lower end portion of the side wall.

* * * * *